United States Patent [19]

Rahnke

[11] 4,369,020

[45] Jan. 18, 1983

[54] ROTOR SEAL FOR WAVE COMPRESSION TURBOCHARGER

[75] Inventor: Christian J. Rahnke, Orchard Lake, Mich.

[73] Assignee: Ford Motor Company, Dearborn, Mich.

[21] Appl. No.: 146,589

[22] Filed: May 5, 1980

[51] Int. Cl.[3] ..... F04F 11/00

[52] U.S. Cl. ..... 417/64

[58] Field of Search ..... 417/64; 60/39.45 A; 123/559; 415/170 R; 418/135, 179

[56] References Cited

U.S. PATENT DOCUMENTS

| | | | |
|---|---|---|---|
| 2,766,928 | 10/1956 | Jendrassik | 417/64 |
| 3,341,112 | 9/1967 | Barnes | 417/64 |
| 3,342,403 | 9/1967 | Brown et al. | 417/64 |
| 3,802,801 | 4/1974 | Wunsch | 417/64 |
| 3,975,165 | 8/1976 | Elbert et al. . | |
| 4,083,650 | 4/1978 | Zboril . | |
| 4,269,570 | 5/1981 | Rao | 417/64 |
| 4,274,811 | 6/1981 | Rao | 417/64 |

*Primary Examiner*—Carlton R. Croyle
*Assistant Examiner*—Edward Look
*Attorney, Agent, or Firm*—Frank G. McKenzie; Donald J. Harrington

[57] ABSTRACT

A wave compression turbocharger has a rotor journalled for rotation about its axis, a first housing, through which air at ambient conditions is admitted to the rotor and from which compressed air is discharged from the rotor. Mounted at one axial end of the rotor, a ceramic port plate has inlet and outlet passages through which exhaust gas enters and exits the rotor. A ceramic spacer extends along the length of the rotor and positions the port plate with respect to the adjacent rotor face and with respect to the first housing. An exhaust gas housing, mechanically joined to the first housing, encapsulates the rotor and the spacer. A preloaded spring applies a clamping force to the spacer holding it in contact with the first housing and accommodates the differences in thermal expansion between the rotor and the exhaust gas housing.

7 Claims, 1 Drawing Figure

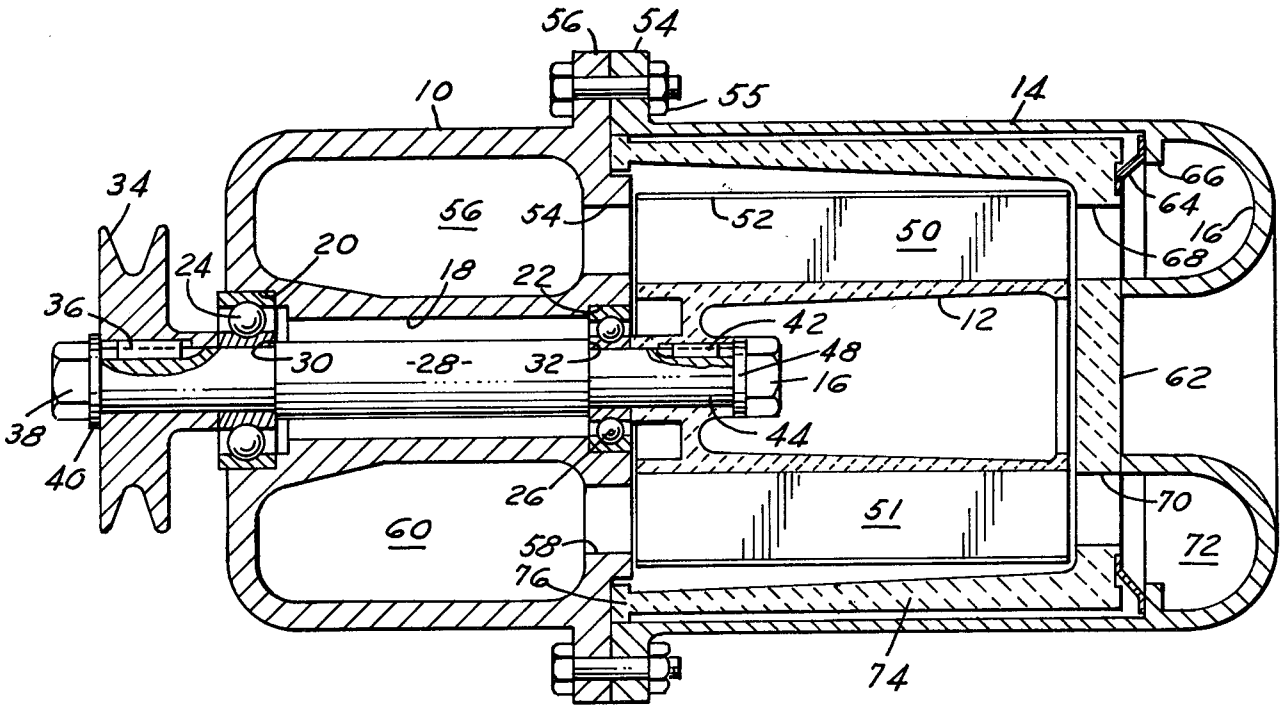
66
64
16
68
62
70
72
14
12
50
51
74
48
16
42
44
52
55
54
56
54
22
32
26
58
76
56
18
-28-
60
10
20
30
24
34
36
40
38

ROTOR SEAL FOR WAVE COMPRESSION TURBOCHARGER

BACKGROUND OF THE INVENTION

1. Field of the Invention

This invention relates to a wave compression turbocharger assembly and more particularly to maintaining a close tolerance seal at the end faces of the rotor.

2. Description of the Prior Art

A wave compression turbocharger is a device for producing an exchange of pressure between the high energy state exhaust gas of an internal combustion engine and atmospheric pressure. Within the turbocharger, the ambient air is compressed and the exhaust gases expanded. A conventional wave compression supercharger includes a cylindrical rotor having radially directed vanes extending from its outer surface. Stationary port plates positioned at opposite ends of the rotor have openings formed through their thicknesses to allow exhaust gas and ambient air to flow into the rotor. Additional openings are provided in the port plates through which the expanded exhaust gas and compressed air flow from the rotor. The pressure exchange takes place within the rotor cells defined by the spaces between the rotor vanes.

The process of compressing the ambient air begins when a rotor cell rotates into alignment with the inlet port, thereby allowing ambient air to flow into and to fill the cell. Rotation then brings the rotor cell into alignment with the exhaust gas inlet port thus admitting a compression wave into the cell which begins to travel along the rotor length in the direction of the ambient air inlet. The exhaust gas temperature can be approximately 1600 degrees Farenheit. The compression wave travels along the rotor ahead of the engine exhaust gas and operates to compress the air in the rotor cell as it travels axially toward the air port plate. The rotor will have rotated out of alignment with the air inlet port when the compression wave has begun to travel down the rotor length and the air side of the rotor cell will have been sealed off by the air port plate.

Immediately before the compression wave reaches the air side of the cell, the cell rotates out of alignment with the exhaust gas inlet port. Next, the rotor brings the cell to the air outlet port thus allowing the compressed air to flow from the rotor due to the action of the compression wave traveling toward the air side of the rotor. The rotor then brings the cell out of communication with the air outlet port and for a brief period of time the rotor cell is closed off at both ends.

It is important to the efficient operation of a compression wave turbocharger that the rotor cells must be sealed tightly during operation. For example, during the compression portion of the rotor cycle while the compression wave is travelling from the gas side to the air side of the rotor, the rotor cell must be sealed at its axial ends to produce optimum compression of the ambient air. If the exhaust gas end of the rotor were not sealed adequately the compression wave would not travel completely along the rotor length to the air port plate and the efficiency of the device would be appreciably reduced.

In a similar way, the exhaust gas is purged from the rotor cell after the pressure wave rebounds from the air port plate surface. The rotor cell rotates into alignment with the exhaust gas outlet port when the rebounding compression wave returns to the exhaust gas port plate.

At the air side of the rotor, the cell is opened to ambient air during the latter portion of the compression wave movement to the gas side so that a partial vacuum tending to resist movement of the turning compression wave is not produced.

It can be seen from this description of the sequence of events within the turbocharger that one axial end of the rotor is continually exposed to the high engine exhaust gas temperatures and that the opposite end of the rotor is kept at a relatively low temperature by the ambient air to which it is continually exposed. Therefore, the rotor has a substantial temperature gradient along its length. Because of the substantial heating of the rotor during operation, the rotor and the housing of the turbocharger experience thermal strain which produces a lengthening of the rotor as compared to its nonoperating condition.

Attempts have been made in the prior art to seal the ends of the rotor by providing a ceramic seal closely fitting the end faces of the rotor when the turbocharger is at ambient temperature. During operation the thermal growth of the rotor causes its end faces to cut into the ceramic seal thus maintaining a closely fitting seal at the elevated temperature. Examples of this means for producing a close tolerance seal between the rotor and the adjacent stator elements is described in U.S. Pat. Nos. 3,975,165 and 4,083,650. With this approach, after the ceramic seal has been formed with a depression caused by the axial growth of the rotor upon cooling, the rotor withdraws from close proximity to the seal, leakage is enhanced and low efficiency results at all temperatures less than the maximum operating temperature at which the depression had been formed. It is preferable for the rotor to be fitted with a close tolerance seal throughout its full operating temperature range. This invention is an improvement in wave compression turbo-chargers having ceramic rotors, examples of which are described in U.S. patent applications Ser. No. 32,198 and 32,324 both filed Apr. 23, 1979, now U.S. Pat. Nos. 4,269,570 and 4,274,811, respectively.

SUMMARY OF THE INVENTION

The wave compression turbocharger according to my invention controls the end clearances between the rotor and the port plates to a close tolerance over the full operating temperature range. The rotor is made from ceramic material, preferably either silicon nitride or silicon carbide or another ceramic material having a coefficient of thermal expansion about 10 percent of the coefficient for steel. The ambient air housing and the exhaust gas housing are positioned at the opposite axial ends of the rotor and are joined by a mechanical attachment. The exhaust gas port plate is made of a ceramic material similar to that of the rotor. The outer face of the port plate is resiliently spaced from an inner surface of the exhaust gas housing so that in operation the differences in thermally induced axial growth of the housing and port plate can be accommodated. Integrally formed with the exhaust gas port plate is a ceramic spacer element, which extends along the length of the rotor and engages the inner face of the air side port plate. The position of the exhaust gas port plate is therefore determined by the length of the spacer and the changes in its length due to thermal expansion.

The housings, which may be formed of metal, will experience considerably greater expansion than will the spacer portion of the ceramic port plate. However, the axial growth of the rotor should closely approximate that of the spacer since they are made of the same ceramic material and have approximately the same temperature gradient along the axial dimension.

It is an object of my invention to maintain a minimal end clearance between the rotor and the port plates over the operating temperature range of the turbocharger. This object is realized because the thermal expansion of the stationary ceramic spacer and the ceramic rotor will maintain these parts at approximately the same length over the temperature range of the turbocharger. Differences in thermal expansion of the housing will not affect the position of the exhaust gas plate with respect to the end face of the rotor because the port plate is positioned from the air side port plate. Furthermore, although the metal exhaust gas housing experiences substantially greater axial growth than the ceramic spacer, the port plate positioned within the housing is structurally disassociated from the housing due to the resilient contact existing between the outer face of the exhaust gas port plate and the inner surface of the housing.

BRIEF DESCRIPTION OF THE DRAWING

The drawing is an elevation cross-section taken through the longitudinal axis of a wave compression turbocharger incorporating the construction of my invention.

DESCRIPTION OF THE PREFERRED EMBODIMENT

Referring to the FIGURE a wave compression turbocharger according to my invention includes an air duct housing 10 positioned at one axial end of a rotor 12 and an engine exhaust gas duct housing 14 extending along the length of the rotor. A volute 16 incorporated in the exhaust gas housing is located at the axially end of the rotor into which engine exhaust gas is admitted.

The exhaust gas duct assembly 14 includes a mounting flange 54 abutting a similar flange 56 on the air duct housing 10. A mechanical attachment passing through the flanges 54, 56 joins the housings, which are formed of metal.

The air duct housing 10 has an axial bore 18 extending along its length and recesses 20, 22 formed on the bore into which are fitted bearings 24 and 26. A shaft 28 is journalled within the bearings, which are spaced on the shaft between the shoulders 30, 32. A pulley 34 is secured at the keyway 36 to an overhung portion of the shaft 28. The outboard end of the shaft 28 is formed with a screwthread engageable by the nut 38 which, upon being drawn up, fixes the pulley 34 between the washer 40 and the inner race of the bearing 24.

The opposite end of the shaft is driveably secured at the keyway 42 to a reduced diameter portion 44 of the shaft. Similarly, the retaining nut 46, upon being drawn up on the external threads at the end of the shaft portion 44, causes the rotor 12 to be secured against the inner race of the bearing 26 and the face of the washer 48.

In this way, torque from the engine crankshaft is delivered to the pulley 34 by way of an endless, flexible belt; rotation of the shaft about its central axis causes the rotor to turn.

The rotor 12 has a plurality of rotor vanes 50 extending radially outwardly from and spaced circumferentially about the rotor hub. The vanes are joined to or formed integrally with the rotor. The outermost edges of the vanes are joined by a cylindrical sleeve that extends axially along the length of the rotor to stiffen and support the vanes against low frequency vibrations. The rotor 12, vanes 50 and sleeve 52 are made from ceramic material, preferably silicon carbide or silicon nitride.

An air inlet port 54 is formed on the inboard surface of the air duct housing 10 and provides a passage through which air at ambient conditions passes from the chamber 56 into and along the rotor chambers between successive rotor vanes. A processed air exhaust port 58 provides a passage through which compressed air exits the rotor chambers and enters the compressed air exit chamber 60. The compressed air passes from chamber 60 through the engine intake manifold and carburetor to the engine cylinders.

An exhaust gas port plate 62 made of ceramic, preferably silicon nitride or silicon carbide, is located within the exhaust gas housing 14 and is resiliently mounted by the annular spring 64 to an interior flange 66 of the housing 14. The port plate has an exhaust gas inlet passage 68, which admits exhaust gas at approximately 1600° F. and elevated pressure into the rotor chambers 50, 51 when they are rotated into communication with the passage 68. An exhaust gas outlet passage 70 formed in the port plate 62 provides a port through which the expanded exhaust gas flows from the rotor chambers and into the chamber 72. Each rotor chamber is brought successively by rotation into registry with the outlet passage 70. The expanded exhaust gas is carried from the outlet chamber 72 and is returned to the exhaust system of the vehicle.

An axially extending spacer 74 is formed integrally or held in abutting contact with the exhaust gas port plate 62. It is made preferably of the same ceramic material as the rotor and port plates. The spacer 74 terminates at a flange 76 which is forced into abutting engagement with the inner face of the air duct housing 10. The load applied by the annular spring 64 is transmitted along the length of the spacer 74 and is reacted by the housing 10 on the flange 76. On assembly a small closely controlled end clearance, of approximately 0.002 inches, exists between the air side face of the rotor 12 and the inner face of the housing. Similarly at the hot side of the rotor an end clearance of between 0.003–0.004 inches exist at cold assembly between the exhaust gas face of the rotor and the inner face of the port plate 62. The average temperature of the rotor exceeds the average temperature of the spacer 74; consequently, there is a disparity in thermal growth between the rotor and the spacer even if made from the identical material. When the turbocharger is operating with ambient air at 70° F. and exhaust gas at approximately 1600° F., the axial length of the ceramic rotor 12 will increase by approximately 0.003 inches and the length of the ceramic spacer will increase approximately 0.001 inches.

Under normal operating conditions the end clearances are reduced as compared to the end clearances existing at cold assembly. At the air side of the rotor the original 0.002 inch clearance is reduced due to the axial thermal expansion of the rotor. The rotor increases in length by 0.002 inches more than the increase in length of the spacer 74. A portion of this difference operates to reduce the cold-assembly end clearance at the exhaust gas side from 0.004 inches to 0.002 inches. Upon cooling from the operating condition, the housing 14 will reduce in length a greater distance than the reduction in the length of the spacer. Accordingly, the spring 64 experiences an increase in load as the turbocharger cools to ambient conditions. On heating to operating temperatures the spring force is reduced. Upon assembly, of course, when the mechanical attachment 55 is drawn up to join the housings 10, 14, a preload is introduced in the spring which is sufficiently high so that it is not overcome at the elevated operating temperatures.

Changes and modifications in the specifically described embodiment can be carried out without departing from the scope of the invention which is intended to be limited only by the scope of the appended claims.

Having thus described a preferred embodiment of my invention, what I claim and desire to secure by U.S. Letters Patent is:

1. A turbocharger comprising:

a rotor mounted for rotation about an axis having surfaces at axially opposite ends;

a housing having a surface that is adjacent and spaced axially from a first end surface of the rotor;

a port plate located adjacent a second end surface of the rotor;

means resiliently urging the port plate toward the second end surface of the rotor; and spacer means abutting the housing and the port plate, defining a predetermined axial length extending from the housing surface that is adjacent the first end surface of the rotor to the port plate, the rotor and the spacer being made of material having a coefficient of thermal expansion that is low in relation to the coefficient of the material from which the housing is made.

2. The turbocharger according to claim 1, wherein the rotor and spacer means are made of ceramic material from the group consisting of silicon nitride and silicon carbide.

3. The turbocharger according to claim 1 wherein the spacer means is positioned between the face of the port plate adjacent the rotor and a surface of the housing, whereby the end clearance between the port plate and the adjacent rotor face is predetermined by the length of the spacer means and the position of the rotor with respect to said surface of the housing.

4. The turbocharger according to claim 1 wherein the spacer means and the port plate are of unitary construction.

5. The turbocharger according to claim 1 further comprising:

a flange formed on the housing adjacent the outboard face of the port plate; and wherein the resilient means is interposed between and engages the flange and the port plate, the resilient means being preloaded during assembly of the turbocharger at room temperature to hold the spacer means in contact with the surface of the housing throughout the operating temperature range of the turbocharger.

6. The turbo charger of claim 1 wherein the port plate has ports through which high temperature gas and low temperature gas enters and leaves the rotor.

7. The turbo charger of claim 1 wherein the end surface of the rotor toward which the port plate is urged is the rotor end surface that is axially opposite the rotor end surface adjacent the housing surface from which the spacer means extends.

* * * * *